US009414703B2

(12) United States Patent
Levine et al.

(10) Patent No.: US 9,414,703 B2
(45) Date of Patent: Aug. 16, 2016

(54) COLLAPSIBLE OR STACKABLE GARMENT HANGER

(71) Applicants: Gregg Myles Levine, Boston, MA (US); Guang Yu Gao, Malden, MA (US); Jennie Nigrosh, Los Angeles, CA (US); Rick Siegel, Los Angeles, CA (US)

(72) Inventors: Gregg Myles Levine, Boston, MA (US); Guang Yu Gao, Malden, MA (US); Jennie Nigrosh, Los Angeles, CA (US); Rick Siegel, Los Angeles, CA (US)

( * ) Notice: Subject to any disclaimer, the term of this patent is extended or adjusted under 35 U.S.C. 154(b) by 0 days.

(21) Appl. No.: 14/559,665

(22) Filed: Dec. 3, 2014

(65) Prior Publication Data

US 2016/0157651 A1 Jun. 9, 2016

(51) Int. Cl.

*A47G 25/40* (2006.01)
*A47G 25/30* (2006.01)
*A47G 25/36* (2006.01)

(52) U.S. Cl.

CPC ..... *A47G 25/4015* (2013.01); *A47G 25/30* (2013.01); *A47G 25/36* (2013.01); *A47G 25/403* (2013.01)

(58) Field of Classification Search

CPC ..... A47G 25/14; A47G 25/34; A47G 25/36; A47G 25/40; A47G 25/403; A47G 25/4046; A47G 25/4061; A47G 25/4015; A47G 25/30; A47F 7/19; A47F 7/22

See application file for complete search history.

(56) References Cited

U.S. PATENT DOCUMENTS 2,716,513 A * 8/1955 Braunstein ..... A47G 25/4023 223/94
2,723,065 A * 11/1955 Vargo ..... A47G 25/4023 223/94
2,728,499 A * 12/1955 Mueller ..... A47G 25/4023 223/94
3,040,941 A * 6/1962 Vargo ..... A47G 25/4023 223/89
3,054,540 A * 9/1962 Wylie ..... A47G 25/403 223/95
3,401,855 A * 9/1968 Balzer ..... A47G 25/403 223/94
3,531,028 A * 9/1970 Vazquez ..... A47G 25/4023 223/94
3,858,770 A * 1/1975 Murray ..... A47G 25/4023 223/94
4,948,019 A * 8/1990 Rodum ..... A47G 25/4023 223/88
4,988,021 A * 1/1991 Adams ..... A47G 25/4023 223/85
2011/0233240 A1* 9/2011 Morawietz ..... A47G 25/442 223/94

FOREIGN PATENT DOCUMENTS

FR 1561454 A * 3/1969

* cited by examiner

*Primary Examiner* — Ismael Izaguirre
(74) *Attorney, Agent, or Firm* — Lyman Smith

(57) ABSTRACT

A garment hanger that is configured to stack with other hangers and/or move between collapsed and extended configurations. The hanger may include an edge defining a recessed area upon one side of the hanger and a corresponding raised area upon the opposite side of the hanger. Multiple hangers may be stacked with one another by engaging the recessed area of a first hanger with the raised area of a second hanger stacked with the first hanger. The hanger may also include one or more extending portions or arms that pivot or otherwise move between the extended configuration for the hanging of garments thereon and a collapsed configuration for shipment or storage. The one or more extending portions or arms may lock or engage with another portion of the hanger when in the extended configuration or collapsed configuration in order to help the hanger remain in such configuration until otherwise desired.

3 Claims, 7 Drawing Sheets

COLLAPSIBLE OR STACKABLE GARMENT HANGER

BACKGROUND

1. Field of the Invention

The present invention relates to a method and apparatus for a garment hanger capable of converting between a collapsed configuration and an extended configuration.

2. Description of the Related Art

The retail garment market expends a large amount of money in the shipment and transportation of goods and proper display devices both around the United States and worldwide. In a typical retail store, many garments such as shirts, pants, dresses, etc. that may be worn by a customer are displayed for purchase upon hangers. These hangers provide a convenient means of exhibiting the garments that are for sale to potential buyers. A potential buyer is able to view and inspect the entire garment, feel the garment's material as it drapes on the hanger, and easily carry the garment to a dressing room to try it on or transport the garment to a cashier for purchase. Given the number of garments offered in even a single store location, the number of hangers needed and the costs associated with the manufacture, transport and storage of such hangers can quickly reach enormous numbers.

Stores incur these substantial expenses in both purchasing the garment hangers themselves and paying the transportation/storage fees of such hangers throughout the desired geographic regions. One major problem with conventional hangers is its large and awkward size or dimensions that make compact packing for transport or storage more difficult. In order to function in a desirable fashion for the display of garments to customers, a conventional hanger typically includes two extending arms making up a bottom end for draping or otherwise holding a garment in place upon the hanger. These extending arms are generally long and skinny compared to the rest of the hanger and substantially impact the overall width of the hanger. In addition to packing cost concerns, the awkward sizing or proportions of conventional hangers, in part due to the extending arms, makes maintaining proper placement within a shipping container (e.g., to prevent slippage or breakage) difficult. In light of these and other issues, an improved garment hanger capable of being more easily and/or less expensively packed, stored, and/or transported would be desired.

SUMMARY

The present invention is related to a method and apparatus for a collapsible garment hanger. In one embodiment, a collapsible garment hanger may include a body portion, a hook portion coupled with the body portion, a first extendible portion coupled with the body portion via a first hinge, the first extendible portion configured to move via the first hinge between an extended configuration and a collapsed configuration, and a second extendible portion coupled with the body portion via a second hinge, the second extendible portion configured to move via the second hinge between an extended configuration and a collapsed configuration.

In another embodiment, a collapsible garment hanger may include a body portion having a first side and a second side, the first side of the body portion defining an edge extending upward from at least a portion of the first side, the second side of the body portion defining a indent disposed into at least a portion of the second side; the edge and the indent having corresponding dimensions to one another, a first extendible portion coupled with the body portion, and a second extendible portion coupled with the body portion, wherein the first extendible portion and the second extendible portion are configured to rotate with respect to the body portion between an extended orientation and a collapsed orientation.

In still another embodiment, a garment hanger system may include a first hanger having a body portion having a protruding area on a first side of the body portion and a recessed area on a second side of the body portion, a hook portion coupled with the body portion, a first extending portion coupled with the body portion, and a second extending portion coupled with the body portion. In addition, a second hanger may have a body portion having a protruding area on a first side of the body portion and a recessed area on a second side of the body portion, a hook portion coupled with the body portion of the second hanger, a first extending portion coupled with the body portion of the second hanger, and a second extending portion coupled with the body portion of the second hanger. The first hanger may be configured to engage with the second hanger via the protruding area of the body portion of the second hanger being received by the recessed area of the body portion of the first hanger.

BRIEF DESCRIPTION OF THE DRAWINGS

The features, objects, and advantages of the present invention will become more apparent from the detailed description set forth below when taken in conjunction with the drawings, wherein.

DETAILED DESCRIPTION

The detailed description of exemplary embodiments herein makes reference to the accompanying drawings and pictures, which show the exemplary embodiment by way of illustration and its best mode. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. For example, the steps recited in any of the method or process descriptions may be executed in any order and are not limited to the order presented. Moreover, any of the functions or steps may be outsourced to or performed by one or more third parties. Furthermore, any reference to singular includes plural embodiments, and any reference to more than one component may include a singular embodiment.

Retail or other commercial establishments can require large numbers of hangers for the draping of garments thereon. These hangers can be subject to a variety of specific requirements that must be satisfied in order for them to be appropriately used or desired in the commercial or retail marketplace. Some of these requirements may be color, material, weight, overall length, overall height, collar dimensions, web thickness, flange/beam thickness, arm angle slope, hook type (e.g., hook opening, hook hanging depth, hook strength, load capacity, color coded size sizer, etc.), and a variety of other performance requirements (e.g., no manufacturing defects such as burrs or rough edges or molding imperfections, impact resistance, bending resistance, heat resistance, cold cracking resistance, etc.). The garment hanger described herein can meet any of a variety of such requirements while being configured to stack and/or collapse for improved shipment or storage, as discussed in greater detail herein.

Figure 1A:
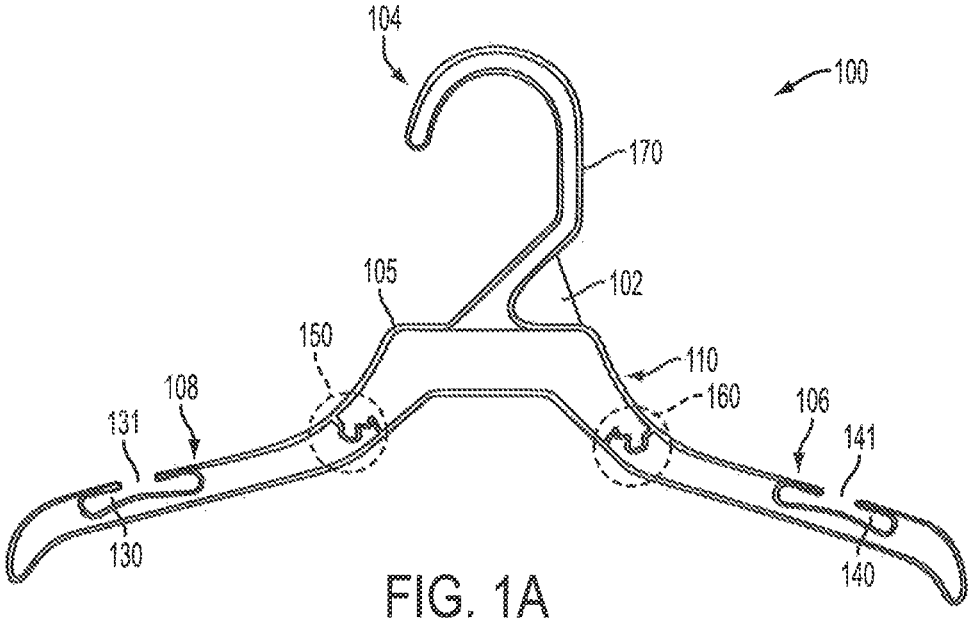
FIG. 1A shows a front view of a collapsible garment hanger in an extended configuration, according to one embodiment of the present invention.

Turning first to FIG. 1A, a front view 100 of a collapsible garment hanger 102 in an extended configuration is shown. The hanger 102 includes a body portion 110 and a hook portion 104 coupled with the body portion 110. The hook portion 104 is formed so as to enable the hanger 102 to hang from an overhead component, such as a bar or rod. Alternative embodiments may utilize similar or different forms, shapes, or proportions for the hook portion 104 depending upon the desired overhead component from which the hanger 102 is to hang therefrom. A first extendible portion 108 is coupled with the body portion 110 at a first connection area 150. A second extendible portion 106 is also coupled with the body portion 110 at a second connection area 160. The first and second connection areas (150, 160) allow portions of the hanger 102 to move between an extended configuration and a collapsed configuration, as discussed in greater detail herein. The first extendible portion 108 defines an opening 130 therein and a slot 131 that permits all or a part of a garment to be placed therein to help maintain the garment upon the hanger 102. Similarly, the second extendible portion 106 defines an opening 140 therein and a slot 141 that permits all or a part of a garment to be placed therein to help maintain the garment upon the hanger 102. For example, a tie, a shoulder strap for a camisole or tank top, a strap connected with a dress, etc. may be inserted into one or both of the openings (130, 140) via the respective slots (131, 141). In one embodiment, the hanger 102 when in the extended configuration may be 12 inches wide by 6.75 inches high by 0.24 inches thick.

Figure 1B:
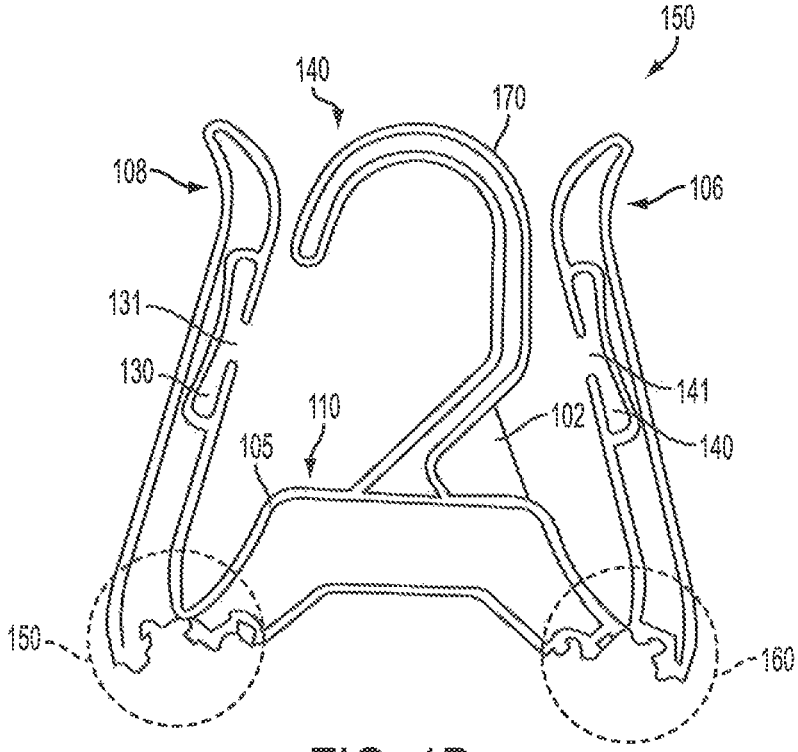
FIG. 1B shows a front view of the collapsible garment hanger of FIG. 1A in a collapsed configuration, according to one embodiment of the present invention.

FIG. 1B shows a front view 150 of the collapsible garment hanger 102 of FIG. 1A, but in a collapsed configuration. As previously noted for FIG. 1A, the collapsible garment hanger 102 includes a body portion 110 and a hook portion 104 coupled with the body portion 110. While the first extendible portion 108 was shown in the extended configuration in FIG. 1A (e.g., pivoted downwards at the first connection area 150 away from the hook portion 140), in FIG. 1B the first extendible portion 108 is instead shown in the collapsed configuration (e.g., pivoted, rotated, or moved upwards at the first connection area 150 towards the hook portion 140). Similarly, while the second extendible portion 106 was shown in the extended configuration in FIG. 1A (e.g., pivoted downwards at the second connection area 160 away from the hook portion 140), in FIG. 1B the second extendible portion 106 is instead shown in the collapsed configuration (e.g., pivoted, rotated, or moved upwards at the second connection area 160 towards the hook portion 140).

In this fashion, the overall dimensions of the hanger 102 changes depending upon whether the hanger is in the extended configuration (i.e., the first extendible portion 108 and/or the second extendible portion 106 being pivoted, rotated, or moved downwards at the first and second connection areas (150, 160), respectively). When in the extended configuration, the hanger 102 has dimensions with a wider overall width due to the first extendible portion 108 and/or the second extendible portion 106 jutting further outwards from the body portion 110 than when in the collapsed configuration. Shipping and/or storing the hanger 102 or a plurality of the hangers 102 in the collapsed configuration may save space and, therefore, money. After shipment and/or storage, the hanger 102 or a plurality of the hangers 102 may be expanded to the extended configuration for use to display garments.

The hanger 102 in the extended and collapsed configurations illustrated by FIGS. 1A and 1B, respectively, also includes an edge (105, 170) or otherwise raised portion extending around at least a portion of the perimeter of the hanger 102. Correspondingly, adjacent to the edge (105, 170) or otherwise raised portion is an area that is lower in elevation than the edge (105, 170). This edge (105, 170) and corresponding lower elevation surface adjacent to the edge (105, 170) aids in facilitating stacking of a plurality of hangers 102 on top of one another, as discussed in greater detail below. In some embodiments, no edge (105, 170) and/or no raised portions, areas or lower or higher elevation may be included on a hanger 102 (e.g., a hanger may be substantially flat and/or flush, and not "interlock" or otherwise couple with an adjacent hanger that is pressed adjacent thereto). Although the embodiment disclosed shows an edge (105, 170) that is distinguished from its corresponding adjacent areas that travels substantially around an entire perimeter of the hanger 102, in an alternative embodiment, raised or lowered portions on a front surface and a rear surface of a hanger that are configured to engage with one another when multiple hangers are stacked may be formed in a variety of different positions and/or dimensions. For example, in one embodiment, a single protrusion (e.g., a bump or bulbous head) may be disposed at a single location on a body portion of a hanger on a front surface while a single socket corresponding in shape to the single protrusion may be disposed at a single location on the body portion of a hanger on a rear surface such that the single protrusion of one hanger mates with the single socket of a second hanger when the first hanger and the second hanger are stacked front-to-back.

Figure 1C:
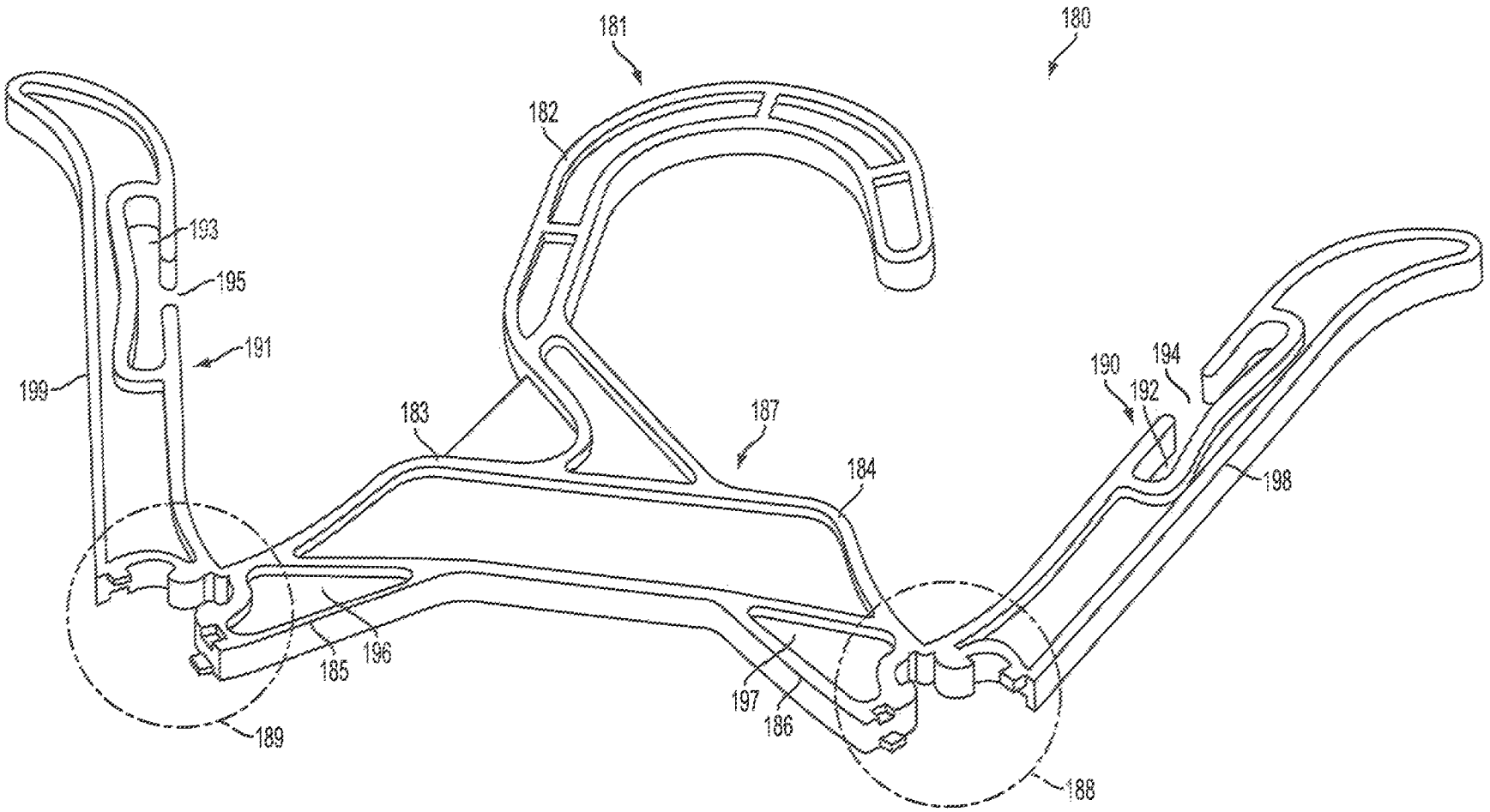
FIG. 1C shows a perspective view of a collapsible garment hanger in a collapsed configuration, according to one embodiment of the present invention.

FIG. 1C shows an additional embodiment of a perspective view 180 of a hanger 183 that may be collapsible and/or stackable. The hanger 183 may include features that are the same as or similar to those previously discussed. For example and as illustrated, the hanger 183 may include a body portion 187 coupled with a hook portion 181. A first extendible portion 191 is coupled with the body portion 187 at a first connection area or segment 189. Likewise, a second extendible portion 190 is coupled with the body portion 187 at a second connection area or segment 188. The first and second extendible portions (191 and 190, respectively) may include openings (195, 194, respectively) therein and slots (193, 192, respectively). The first and/or second extendible portions (191, 190) are configured to pivot or otherwise rotate via their respective connection areas or segments (189, 188). In certain embodiments, the first and/or second extendible portions (191, 190) may be configured to pivot or rotate only once before becoming permanently positioned. For example, the hanger 183 may initially be manufactured in a collapsed configuration as illustrated in FIG. 1C, such as for shipping and/or storage, whereby once the first and/or second extendible portions (191, 190) are engaged or interlocked with the body portion 187 at the first and/or second connection areas or segments (189, 188), as discussed in greater detail herein, the hanger 187 is configured to permanently remain in such expanded configuration and the first and/or second extendible portions (191, 190) are no longer configured to be disengaged from the body portion 187 in order to return to the collapsed configuration. Similar to previous discussions, the hanger 187 may include an edge (184, 182, 199, 198) disposed around at least a portion of a perimeter of the hanger 187.

A first downward segment 185 of the body portion 187 may include a depression 196 therein. Likewise a second downward segment 186 of the body portion 187 may include a depression 197 therein. The first and/or second downward segments (185, 186) may provide improved connection and/or rotation of the first and/or second extendible portions (191, 190). In addition or alternatively, such features may provide desired weight savings and/or manufacturing ease in certain embodiments. Various of these features and/or structural elements may be the same as or similar to those previously discussed.

Figure 2A:
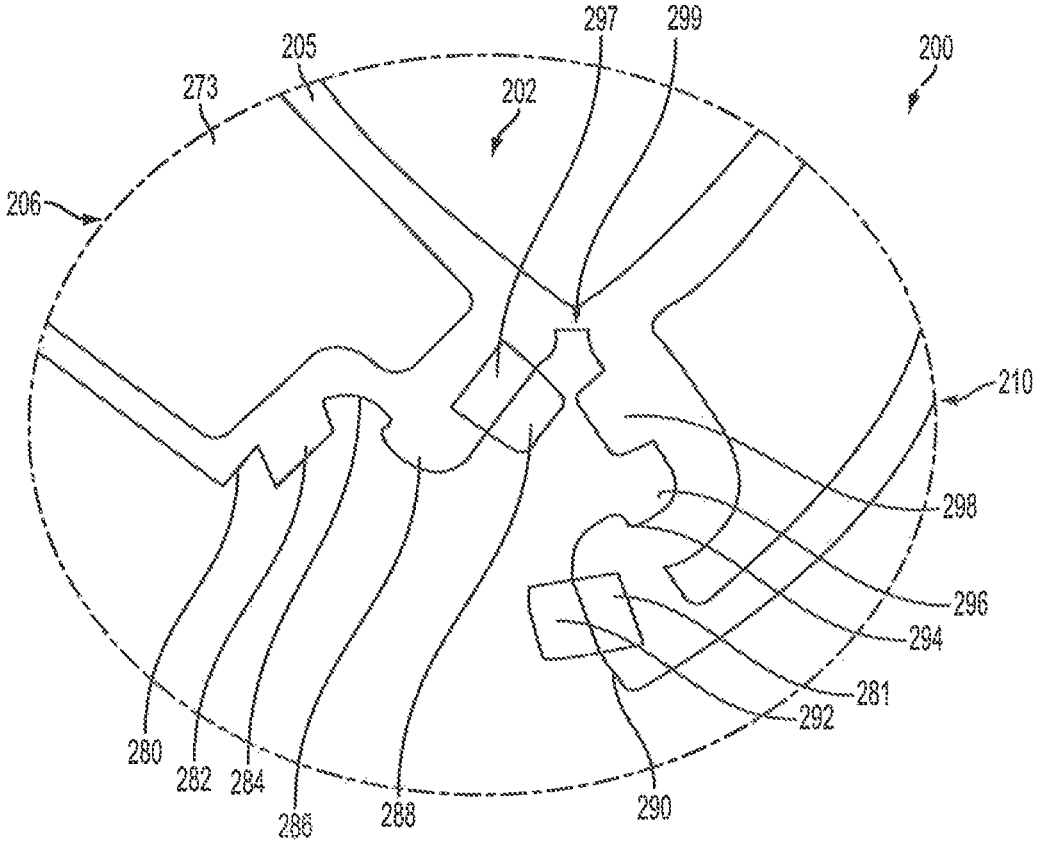
FIG. 2A shows a zoomed-in front view of a collapsible garment hanger when not in an extended configuration, according to one embodiment of the present invention.
Figure 2B:
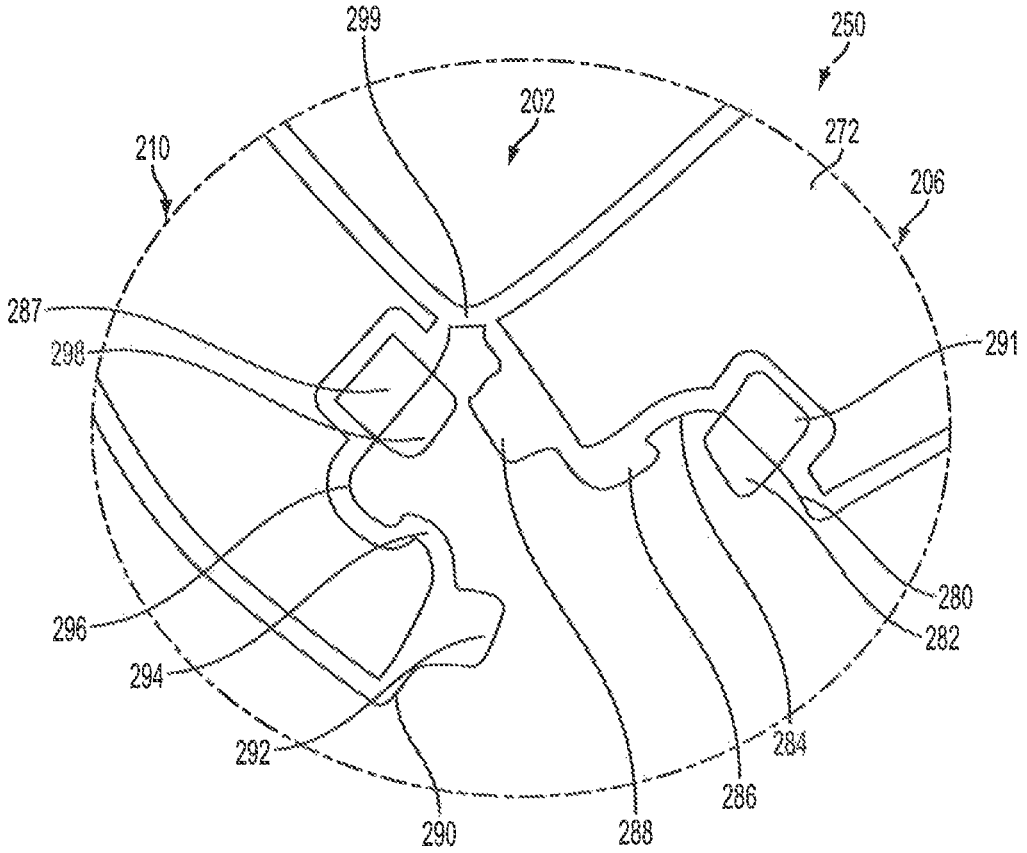
FIG. 2B shows a zoomed-in rear view of the collapsible garment hanger of FIG. 2A when not in an extended configuration, according to one embodiment of the present invention.
Figure 2C:
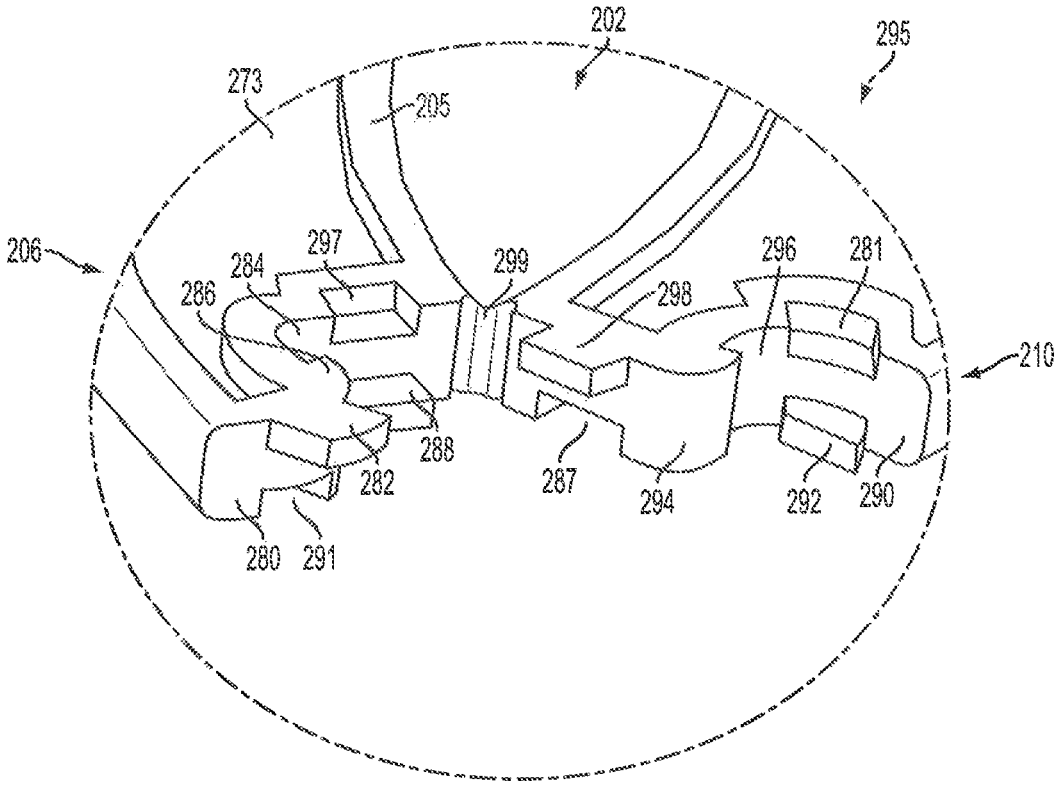
FIG. 2C shows a zoomed-in perspective view of the collapsible garment hanger of FIG. 2A when not in an extended configuration, according to one embodiment of the present invention.

Turning next to FIG. 2A, a zoomed-in front view 200 of a portion of a collapsible garment hanger 202 that is not in an extended configuration is shown. Similarly, FIG. 2B shows a zoomed-in rear view 250 of the portion of the collapsible garment hanger 202 of FIG. 2A. Likewise, FIG. 2C shows a zoomed-in perspective view of the portion of the collapsible garment hanger 202 of FIGS. 2A and 2B. In each of FIGS. 2A-C, the collapsible garment hanger 202 may include features that are the same as or similar to those previously discussed.

The hanger 202 includes a body portion 210 that connects with an extendible portion 206 via a hinge or other connection component, element, or mechanism 299. The connection of the extendible portion 206 with the body portion 210 allows the hanger 202 to move between an extended configuration and a collapsed configuration, the same as or similar to previous discussions. As discussed in greater detail below, various elements and/or surfaces of the extendible portion 206 are configured to engage with corresponding elements and/or surfaces of the body portion 210 when the hanger 202 is in the extended configuration. This helps to aid in the stability of the hanger 202 and/or to help maintain the hanger 202 in the extended configuration until it is desired by user manipulation to move or change to the collapsed configuration.

As illustrated in FIGS. 2A-2C, the extendible portion 206 includes a first protrusion 282 that extends outwardly from between a first connecting surface 280 and a second connecting surface 284. The first protrusion 282 may only extend partially from the front surface of the extendible portion 206 such that it is not the same overall thickness of the extendible portion 206 (e.g., see FIG. 2C). For example, it may only extend from a front surface of the extendible portion 206 (i.e., is flush with the front surface of the extendible portion 206, but not flush with the rear surface of the extendible portion 206). A corresponding first socket 281 is disposed in the body portion 210 between a first connecting surface 290 of the body portion 210 and a second connecting surface 296 of the body portion 210. Thus, when the extendible portion 206 is rotated, pivoted, or otherwise moved via hinge 299 to the extended configuration, the first protrusion 282 of the extendible portion 206 is received by the first socket 281 of the body portion 210.

In similar fashion, a first protrusion 292 of the body portion 210 corresponds to a first socket 291 disposed in the extendible portion 206, as shown. When the extendible portion 206 is rotated, pivoted, or otherwise moved via hinge 299 to the extended configuration, the first protrusion 292 of the body portion 210 is received by the first socket 291 of the extendible portion 206. Once both protrusions are fully received by their respective sockets, the first and second connecting surfaces (280, 284) of the extendible portion 206 meet the first and second connection surfaces (290, 296) of the body portion 210, respectively. The first and second connecting surfaces (280, 284) of the extendible portion 206 have a similar, but opposite or reverse shape when compared to the first and second connection surfaces (290, 296) of the body portion 210 so that a close fit between the extendible portion 206 and the body portion 210 is maintained.

The extendible portion 206 also includes a second protrusion 288 that extends outwardly from an adjacent third connecting surface 286. The second protrusion 288 of the extendible portion 206 may only extend partially from the front surface of the extendible portion 206 such that it is not the same overall thickness of the extendible portion 206 (e.g., see FIG. 2C). For example, it may only extend from a rear surface of the extendible portion 206 (i.e., is flush with the rear surface of the extendible portion 206, but not flush with the front surface of the extendible portion 206). A corresponding second socket 287 is disposed in the body portion 210 adjacent to a third connecting surface 294 of the body portion 210. Thus, when the extendible portion 206 is rotated, pivoted, or otherwise moved via hinge 299 to the extended configuration, the second protrusion 288 of the extendible portion 206 is received by the second socket 287 of the body portion 210.

In similar fashion, a second protrusion 298 of the body portion 210 corresponds to a second socket 297 disposed in the extendible portion 206, as shown. When the extendible portion 206 is rotated, pivoted, or otherwise moved via hinge 299 to the extended configuration, the second protrusion 298 of the body portion 210 is received by the second socket 297 of the extendible portion 206. Once both protrusions are fully received by their respective sockets, the third connecting surface 286 of the extendible portion 206 meets the third connecting surface 294 of the body portion 210. The third connecting surface 286 of the extendible portion 206 has a similar, but opposite or reverse shape, when compared to the third connecting surface 294 of the body portion 210 so that a close fit between the extendible portion 206 and the body portion 210 is maintained.

The hanger 202 shown in FIGS. 2A-2C also facilitates improved stacking with a plurality of other hangers 202. A front side of the hanger 202 (e.g., FIGS. 2A and 2C) illustrates a raised edge 205 disposed around at least a portion of a perimeter of the hanger 202. This raised edge is adjacent to a recessed area 273 that has a lower elevation or height than the edge 205. The back side of the hanger 202 (e.g., FIG. 2B) illustrates a raised area 272 that corresponds in position to the recessed area 273 on the front side of the hanger 202. Thus, if one hanger 202 was stacked front-to-back with a second hanger 202, the raised area 272 on a back side of the first hanger 202 would fit within and engage with the recessed area 273 on the front side of the second hanger 202. Such stacking aids in preventing a plurality of hangers from shifting in position during storage and/or transit, making compacting multiple hangers together easier and less costly. In another embodiment, a hanger may not be configured to couple or engage with an adjacent hanger to facilitate stacking. For example, one embodiment may have two areas configured the same (e.g., two recessed areas 273, two raised areas 272, and/or two flush areas) located on either sides of a hanger, rather than recessed area 273 and a corresponding raised area 272 configured to mate together. Any of a variety of different positions, shapes, orientations, locations, and/or proportions for the stacking edges and/or areas may be used in an alternative embodiment.

Alternative embodiments utilizing different numbers of protrusions, sockets, and/or connecting surfaces are possible. In certain embodiments, no protrusions and/or sockets may be needed. In still other embodiments, protrusions and/or sockets may be shaped or oriented differently. For example, one embodiment may form one or more protrusions with a head portion that has a larger width or diameter than a connected neck portion such that the protrusion may "snap" into a receiving socket. In this fashion, the hanger may be held in the extended configuration until a user exhibits a predetermined amount of force in order to free the protrusion from the receiving socket.

In still other embodiments, protrusions and/or sockets may be disposed at differing locations of the hanger. For example, one or more protrusions and/or corresponding sockets may be disposed such that they can engage with one another when the hanger is in a collapsed configuration. In such an embodiment, the hanger may be held in the collapsed configuration until a user exhibits a predetermined amount of force in order to free the protrusion from the receiving socket.

Figure 3:
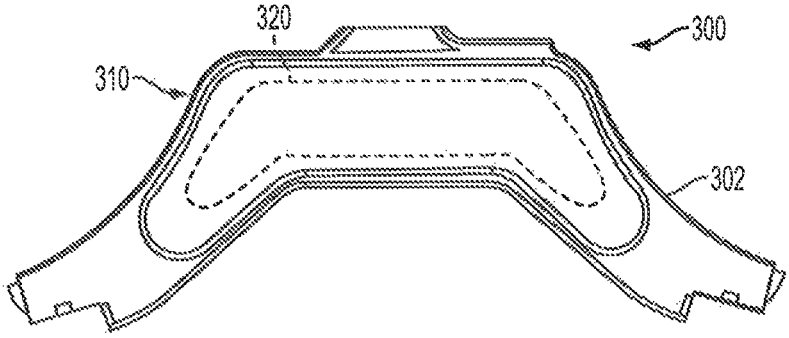
FIG. 3 shows a front view of a portion of a collapsible garment hanger for placement of advertisements, according to one embodiment of the present invention.

FIG. 3 shows a front view 300 of a portion of a collapsible garment hanger 302 that may be used for placement of advertisements, logos, or any of a variety of other textual or graphical images or prints. The hanger 302 may include features that are the same as or similar to those previously discussed. The hanger 302 includes a body portion 310 and an area 320 on the body portion 310 for the placement of desired text or other images. The area 320 may take up substantially all of the surface area of the body portion 310 and thus configured to place text or graphics on substantially all of the body portion 310. In an alternative embodiment, the area 320 may be smaller in size such that only a smaller portion of the surface area of the body portion 310 is configured to be covered by text or graphics.

The text or graphics may be permanently affixed to the body portion 310 of the hanger 302 in the area 320. For example, the area 320 may be created out of a material conducive to permanent printing thereupon (e.g., certain metal, plastics, etc.) and such text or graphics may be printed with ink or otherwise branded within the area 320 such that it is not intended to be easily removable. In another embodiment, the text or graphics may be temporarily affixed to the body portion 310 of the hanger 302 in the area 320. In one example, the text or graphics may be applied via a sticker or other adhesive. In another example, the area 320 may be created out of a material conducive to temporary printing thereupon (e.g., certain metals, plastics, etc.) and such text or graphics may be disposed within the area 320 such that the text or graphics can be eliminated (e.g., via a chemical solution, etc.). Such temporary printing allows new text or graphics to be displayed upon the hanger 302 if the manufacturer and/or retailer and/or other entity desires to update or modify the text or graphics without having to throw away the hanger 302. For example, this may be desired in retail stores to promote current or upcoming sales, to promote current or upcoming goods offered to customers, etc. In another embodiment, the text and/or graphics may be applied via a tool insert during the manufacture of the body portion 310 of the hanger 302. In this fashion, different inserts having different text and/or graphics may be used during manufacture in order to create the body portion 310 of the hanger 302 with the desired text and/or graphics manufactured as part of the body portion 310 such that a second pass or step (e.g., a stamping/printing pass) need not be performed upon the body portion 310 of the hanger 302 after manufacture. Although illustrated having particular dimensions, in an alternative embodiment, the area 320 may have any of a variety of shapes and/or configurations.

Figure 4:
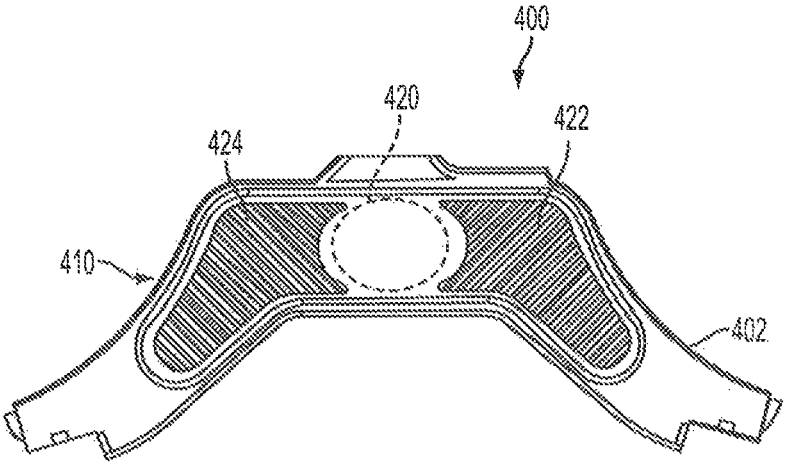
FIG. 4 shows a front view of a portion of a collapsible garment hanger for cut-out, according to one embodiment of the present invention.

FIG. 4 shows a front view 400 of a portion of a collapsible garment hanger 402 for one or more cut-outs. The hanger 402 may include features that are the same as or similar to those previously discussed. The hanger 402 includes a body portion 410 that contains an area 420 thereupon for the printing, inserting, or placement of text or graphics (e.g., logos, advertisements, etc.). This area 420 may include features that are the same as or similar to those previously discussed for FIG. 3. The body portion 410 of the hanger 402 includes a first cut-out section 422 and a second cut-out section 424. The first and/or second cut-out sections (422, 424) may help reduce the overall weight of the hanger 422 such that the hanger 402 may be less expensive to manufacture and/or transport. Although illustrated having particular dimensions, in an alternative embodiment, the first cut-out section 422 and/or the second cut-out section 424 may have any of a variety of shapes and/or configurations. Greater (e.g., 3+) or fewer (zero or one) cut-out section may be used in an alternative embodiment.

Figure 5A:
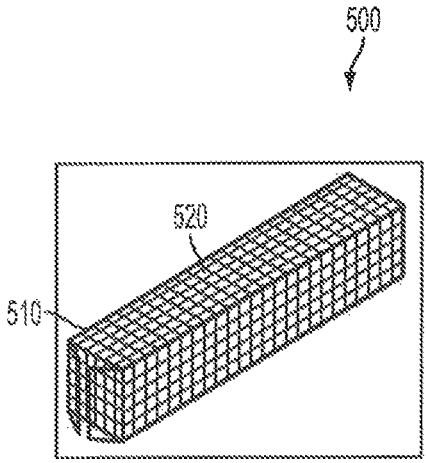
FIG. 5A shows a perspective view of a shipping container for transporting garment hangers of extended configurations.
Figure 5B:
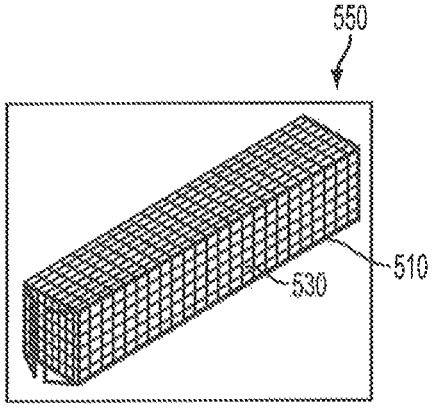
FIG. 5B shows a perspective view of a shipping container for transporting garment hangers of collapsed configurations.

Turning next to FIG. 5A, a perspective view 500 of a shipping container 510 is shown for transportation of garment hangers in extended configurations. Similarly, FIG. 5B shows a perspective view 550 of the shipping container 510 for transportation of garment hangers in collapsed and/or stacked configurations. As illustrated, the shipping container 510 has particular dimensions for length, width, and height such that only a particular number cases 520 of extended configuration hangers will fit in the shipping container 510. For example, the shipping container 510 holding cases 520 may only be capable of transporting 720 cases 520 containing extended configuration hangers packed therein if a single case 520 had dimensions of 50 cm by 37 cm by 50 cm. Alternatively, since shipment of hangers that are in a collapsed and/or stacked configuration may allow for a greater number of hangers to be contained within the same volume as hangers in an extended configuration (e.g., see discussion above), cases 530 of collapsed and/or stacked configuration hangers allow for a greater number of hangers (e.g., 1080 cases 520 containing collapsed and/or stacked configuration hangers packed therein if a single case 530 had dimensions of 26 cm by 41 cm by 60 cm) to be contained within the same shipping container 510. A given case (either case 520 or case 530) may contain the same number of hangers therein (e.g., 800 hangers), but since a greater number of cases 530 may fit within the same shipping container 510 when compared against cases 520, time and/or money in transportation costs and other expenses in the shipment and/or storage of hangers for retail or other establishments may be achieved.

The previous description of the disclosed examples is provided to enable any person of ordinary skill in the art to make or use the disclosed methods and apparatus. Various modifications to these examples will be readily apparent to those skilled in the art, and the principles defined herein may be applied to other examples without departing from the spirit or scope of the disclosed method and apparatus. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope. Skilled artisans may implement the described functionality in varying ways for each particular application, but such implementation decisions should not be interpreted as causing a departure from the scope of the disclosed apparatus and methods. The steps of the method or algorithm may also be performed in an alternate order from those provided in the examples.

What is claimed is:

1. A garment hanger system comprising:

a first hanger having:

a body portion having a recessed area on a first side of the body portion and a raised area on a second side of the body portion, a hook portion coupled with the body portion, a first extending portion coupled with the body portion, and a second extending portion coupled with the body portion; and a second hanger having:

a body portion having a recessed area on a first side of the body portion and a raised area on a second side of the body portion, a hook portion coupled with the body portion of the second hanger, a first extending portion coupled with the body portion of the second hanger, and a second extending portion coupled with the body portion of the second hanger, wherein the first hanger is configured to engage with the second hanger via the raised area of the body portion of the first hanger being received by the recessed area of the body portion of the second hanger.

2. The collapsible garment hanger system of claim 1 wherein:

the first extending portion of the first hanger or the second extending portion of the first hanger is configured to rotate with respect to the body portion of the first hanger, and the first extending portion of the second hanger or the second extending portion of the second hanger is configured to rotate with respect to the body portion of the second hanger.

3. The collapsible garment hanger system of claim 2 wherein:

the first extending portion of the first hanger has a first side and a second side, the first extending portion of the first hanger having a first protrusion that is flush with the first side of the first extending portion of the first hanger and not flush with the second side of the first extending portion of the first hanger, the first extending portion of the first hanger having a second protrusion that is flush with the second side of the first extending portion of the first hanger and not flush with the first side of the first extending portion of the first hanger;

the second extending portion of the first hanger has a first side and a second side, the second extending portion of the first hanger having a first protrusion that is flush with the first side of the second extending portion of the first hanger and not flush with the second side of the second extending portion of the first hanger, the second extending portion having a second protrusion that is flush with the second side of the second extending portion of the first hanger and not flush with the first side of the second extending portion of the first hanger; and the body portion of the first hanger has a first socket configured to engage with the first protrusion of the first extending portion of the first hanger when the first extending portion of the first hanger is in the extended configuration, a second socket configured to engage with the second protrusion of the first extending portion of the first hanger when the first extending portion of the 1irst hanger is in the extended configuration, a third socket configured to engage with the first protrusion of the second extending portion of the first hanger when the second extending portion of the first hanger is in the extended configuration, and a fourth socket configured to engage with the second protrusion of the second extending portion of the first hanger when the second extending portion of the first hanger is in the extended configuration.

* * * * *